US011484097B2

(12) United States Patent
Durand

(10) Patent No.: US 11,484,097 B2
(45) Date of Patent: Nov. 1, 2022

(54) FOOTWEAR UPPER WITH BRANCHED FOREFOOT STRAPS

(71) Applicant: NIKE, Inc., Beaverton, OR (US)

(72) Inventor: Thomas Durand, Toulouse (FR)

(73) Assignee: NIKE, Inc., Beaverton, OR (US)

( * ) Notice: Subject to any disclaimer, the term of this patent is extended or adjusted under 35 U.S.C. 154(b) by 15 days.

(21) Appl. No.: 16/832,025

(22) Filed: Mar. 27, 2020

(65) Prior Publication Data

US 2020/0329819 A1 Oct. 22, 2020

Related U.S. Application Data

(60) Provisional application No. 62/835,036, filed on Apr. 17, 2019.

(51) Int. Cl.

| | |
|---|---|
| ***A43C 1/04*** | (2006.01) |
| ***A43B 23/02*** | (2006.01) |
| ***A43C 5/00*** | (2006.01) |

(52) U.S. Cl.

CPC ..... *A43C 1/04* (2013.01); *A43B 23/026* (2013.01); *A43B 23/0265* (2013.01); *A43C 5/00* (2013.01)

(58) Field of Classification Search

CPC ..... A43B 7/14; A43B 7/1495; A43B 23/0265; A43C 1/04

USPC ..... 36/265, 88, 50.1

See application file for complete search history.

(56) References Cited

U.S. PATENT DOCUMENTS

| | | | | |
|---|---|---|---|---|
| 3,138,880 | A * | 6/1964 | Kunzli | A43B 5/025 36/105 |
| 5,042,120 | A * | 8/1991 | Nichols | A43C 1/04 24/713.2 |
| 5,184,378 | A * | 2/1993 | Batra | A43C 1/04 24/714.8 |
| 5,377,430 | A * | 1/1995 | Hatfield | A43B 3/08 36/51 |
| D386,896 | S * | 12/1997 | Fogg | D2/972 |
| 5,692,320 | A * | 12/1997 | Nichols | A43C 1/02 36/51 |
| 6,286,233 | B1 * | 9/2001 | Gaither | A43C 1/00 36/50.1 |

(Continued)

FOREIGN PATENT DOCUMENTS

| | | |
|---|---|---|
| CN | 201352976 Y | 12/2009 |
| CN | 103841851 A | 6/2014 |

(Continued)

*Primary Examiner* — Heather Mangine
*Assistant Examiner* — Raquel M. Weis
(74) *Attorney, Agent, or Firm* — Quinn IP Law

(57) ABSTRACT

An upper for an article of footwear includes a base layer, an exterior layer, a first strap, and a second strap. The exterior layer at least partially covers an outer side of the base layer and defines a first aperture and a second aperture both in a forefoot region. Each strap includes a central portion, a front branch, and a rear branch, the front and rear branches disposed between the outer side of the base layer and the exterior layer. The front branch of the second strap crosses the rear branch of the first strap and is disposed forward of the rear branch of the first strap at the lower extent of the base layer. The central portion of the first strap extends through the first aperture and defines a first loop, and the central portion of the second strap extends through the second aperture and defines a second loop.

19 Claims, 11 Drawing Sheets

(56) References Cited

U.S. PATENT DOCUMENTS 6,298,582 B1 * 10/2001 Friton ..... A43B 23/027 36/102
6,568,103 B2 * 5/2003 Durocher ..... A43C 3/00 24/712.1
7,325,337 B2 * 2/2008 Cox ..... A43B 1/0027 36/100
7,343,701 B2 * 3/2008 Pare ..... A43C 1/06 36/88
7,600,334 B2 * 10/2009 Cox ..... A43B 3/24 36/100
7,774,956 B2 * 8/2010 Dua ..... A43B 23/0235 36/9 R
8,215,033 B2 * 7/2012 Carboy ..... A43B 1/04 36/50.1
D675,008 S * 1/2013 VanHook ..... D2/972
8,713,820 B2 * 5/2014 Kerns ..... A43C 1/04 36/88
8,800,172 B2 * 8/2014 Dua ..... A43B 23/0275 36/55
8,844,167 B2 * 9/2014 Greene ..... A43B 13/223 36/50.1
8,869,435 B2 * 10/2014 Hatfield ..... A43B 23/027 36/102
8,875,418 B2 * 11/2014 Long ..... A43B 23/0265 36/50.1
8,959,799 B2 * 2/2015 Nishiwaki ..... A43B 7/1495 36/50.1
9,125,455 B2 * 9/2015 Kerns ..... A43C 1/00
9,179,739 B2 * 11/2015 Bell ..... A43C 1/00
9,226,548 B2 * 1/2016 Follet ..... D04B 21/20
9,854,873 B2 * 1/2018 Kerns ..... A43C 11/16
9,888,743 B2 * 2/2018 Bell ..... A43B 3/04
10,136,701 B2 * 11/2018 Klein ..... A43B 23/026
10,182,608 B2 * 1/2019 Smith ..... A43B 1/0072
10,945,491 B2 * 3/2021 Cooper ..... A43B 23/0245
2002/0148142 A1 * 10/2002 Oorei ..... A43B 23/0255 36/129
2004/0181972 A1 * 9/2004 Csorba ..... A43B 23/0265 36/50.1
2004/0205982 A1 * 10/2004 Challe ..... A43B 23/07 36/55
2005/0081403 A1 * 4/2005 Mathieu ..... A43C 7/00 36/50.1
2005/0217145 A1 * 10/2005 Miyauchi ..... A43B 13/181 36/27
2006/0059715 A1 * 3/2006 Aveni ..... A43C 9/00 36/45
2007/0068041 A1 * 3/2007 Farys ..... A43B 23/17 36/50.1
2008/0110048 A1 * 5/2008 Dua ..... A43B 3/0031 12/146 C
2008/0110049 A1 * 5/2008 Sokolowski ..... A43C 1/04 36/50.1
2009/0071041 A1 * 3/2009 Hooper ..... A43B 23/0245 36/25 R
2010/0064547 A1 * 3/2010 Kaplan ..... A43C 1/04 36/50.1
2010/0107442 A1 * 5/2010 Hope ..... A43B 23/0245 36/50.1
2011/0041359 A1 * 2/2011 Dojan ..... A43C 1/00 36/47
2011/0113648 A1 * 5/2011 Leick ..... A43B 5/14 36/50.1
2011/0225843 A1 * 9/2011 Kerns ..... A43C 11/20 36/50.1
2011/0308115 A1 * 12/2011 Le ..... A43B 7/1495 36/83
2012/0011744 A1 * 1/2012 Bell ..... A43B 19/00 36/91
2012/0198727 A1 * 8/2012 Long ..... A43B 23/0235 36/25 R
2013/0019500 A1 * 1/2013 Greene ..... A43B 23/025 36/50.1
2013/0104423 A1 * 5/2013 Hatfield ..... A43B 23/027 36/103
2013/0160328 A1 * 6/2013 Hatfield ..... A43B 7/20 36/103
2013/0192091 A1 * 8/2013 Kohatsu ..... A43B 5/00 36/103
2014/0005585 A1 * 1/2014 Berns ..... A61F 13/622 602/27
2014/0130372 A1 * 5/2014 Aveni ..... D04B 1/22 36/83
2014/0173933 A1 * 6/2014 Bell ..... A43B 23/042 36/84
2014/0173934 A1 * 6/2014 Bell ..... A43B 23/0265 36/84
2014/0196316 A1 * 7/2014 Follet ..... A43C 1/04 36/84
2015/0257476 A1 * 9/2015 Panian ..... A43B 13/22 36/114
2015/0272275 A1 * 10/2015 Dojan ..... A43B 23/0265 36/88
2015/0342261 A1 * 12/2015 Boucher ..... A41B 11/007 12/142 G
2016/0007687 A1 * 1/2016 Surace ..... A43B 7/14 36/89
2016/0058121 A1 * 3/2016 Langvin ..... A43B 13/187 36/103
2016/0088902 A1 * 3/2016 Bell ..... A43C 1/00 36/50.1
2016/0095387 A1 * 4/2016 Follet ..... A43B 1/04 24/714.7
2016/0095388 A1 * 4/2016 Beye ..... A43C 1/04 36/50.1
2016/0219982 A1 * 8/2016 Waatti ..... A43C 5/00
2016/0286903 A1 * 10/2016 Whewell ..... A43B 23/0265
2016/0302524 A1 * 10/2016 Smith ..... A43B 13/12
2016/0324254 A1 * 11/2016 McDonald ..... A43B 13/141
2016/0331083 A1 * 11/2016 Uesato ..... A43C 1/04
2016/0345673 A1 * 12/2016 Humphrey ..... A43C 19/00
2017/0020231 A1 * 1/2017 Hausmann ..... A43B 23/0265
2017/0027286 A1 * 2/2017 Luedecke ..... A43C 1/00
2017/0105486 A1 * 4/2017 Klein ..... A43B 23/021
2017/0105487 A1 * 4/2017 Klein ..... A43C 1/00
2017/0143075 A1 * 5/2017 Nonogawa ..... A43B 23/026
2017/0181501 A1 * 6/2017 Gautier ..... A43B 23/088
2017/0202310 A1 * 7/2017 Spanks ..... A43B 5/10
2017/0208900 A1 * 7/2017 Boucher ..... A43B 23/0215
2017/0215523 A1 * 8/2017 Nishiwaki ..... A43B 23/028
2017/0231319 A1 * 8/2017 Bohnsack ..... A43B 13/04 36/92
2018/0035759 A1 * 2/2018 Pollack ..... A43C 1/04
2018/0249787 A1 * 9/2018 Fuerst, Sr. ..... A43B 3/12
2018/0255877 A1 * 9/2018 Wilson ..... A43C 1/003
2018/0317607 A1 * 11/2018 Yamamoto ..... A43B 23/027
2018/0338566 A1 * 11/2018 Hatfield ..... A43B 7/20
2018/0343963 A1 * 12/2018 Bruce ..... D04C 1/06
2018/0343966 A1 * 12/2018 Cook ..... A43B 7/1455
2019/0017205 A1 * 1/2019 Luedecke ..... A43B 23/026
2019/0037970 A1 * 2/2019 Klug ..... A43C 1/04
2019/0082792 A1 * 3/2019 Cooper ..... A43B 23/0265

FOREIGN PATENT DOCUMENTS

EP 0734662 A1 10/1996
EP 2084981 A1 8/2009
WO 2009156625 A2 12/2009
WO WO-2009156625 A2 * 12/2009 ..... A43B 23/0275
WO 2016191752 A1 12/2016
WO WO-2016191752 A1 * 12/2016 ..... A43B 23/088
WO 2017015190 A1 1/2017

* cited by examiner

FOOTWEAR UPPER WITH BRANCHED FOREFOOT STRAPS

CROSS-REFERENCE TO RELATED APPLICATIONS

This application claims the benefit of priority to U.S. Provisional Application No. 62/835,036 filed Apr. 17, 2019, which is hereby incorporated by reference in its entirety.

TECHNICAL FIELD

The present disclosure generally relates to footwear and footwear uppers having lace-engaging straps.

BACKGROUND

Footwear may include a sole structure configured to be located under a wearer's foot to space the foot away from the ground. A footwear upper attached to the sole structure receives the foot. The fit of the upper to the foot may be adjusted with a closure system so that the upper is loose enough to receive the foot but can be tightened around the foot to secure the foot relative to the sole structure. For example, a closure system, such as a lacing system, may include laces that are tied once the foot is received within the upper.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
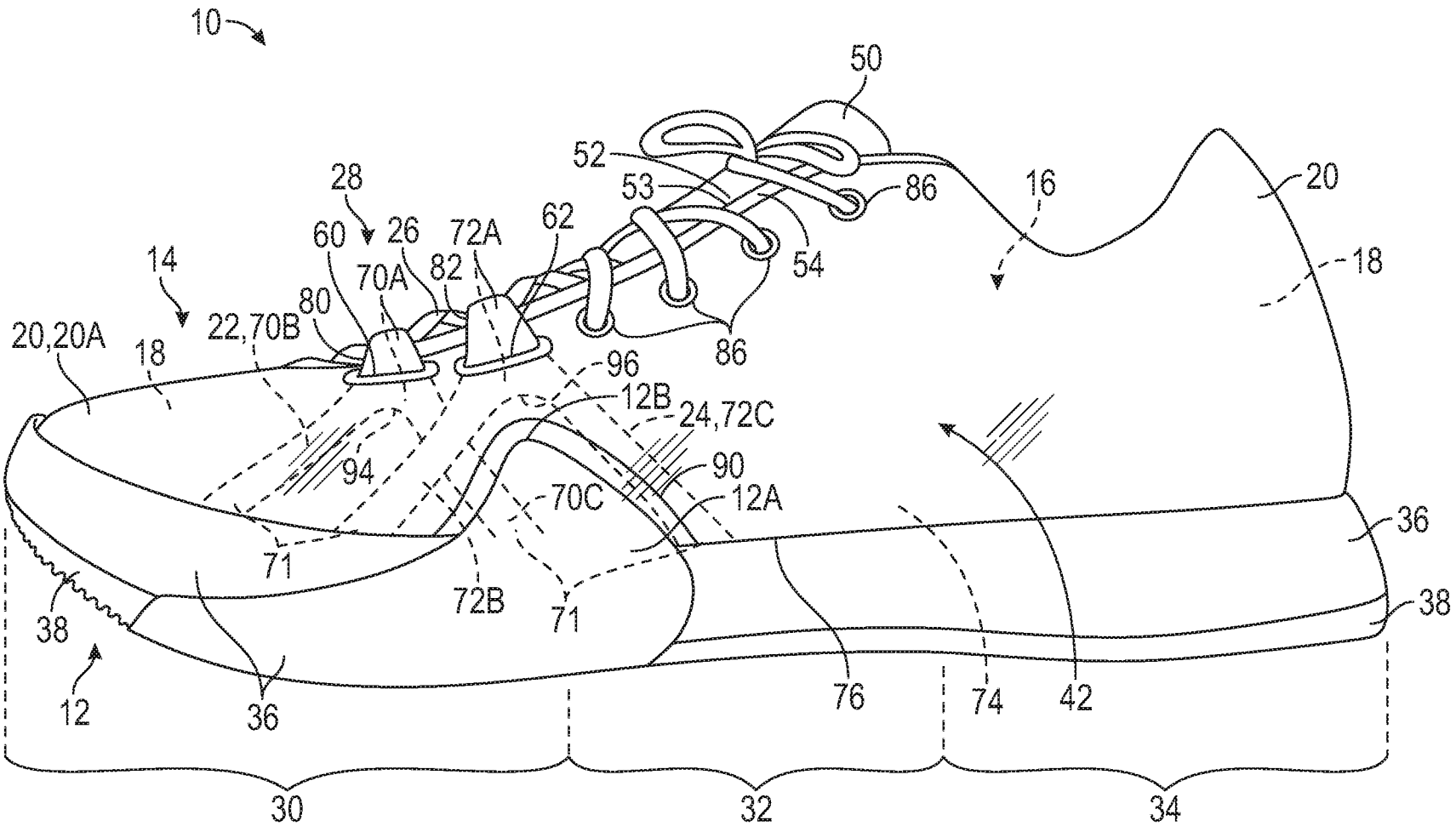
FIG. 1 is a lateral side view of an article of footwear having an upper including first and second straps engaged with a lace.

The present disclosure generally relates to an upper for an article of footwear and to an article of footwear. The upper includes overlapping anchoring straps that extend out from between layers of the upper and engage with a lace. The anchoring straps and the lace comprise a closure system that secures the foot relative to the upper and a sole structure while providing lateral support and stability and dispersing loading forces during wear.

More specifically, an upper for an article of footwear may comprise a base layer configured to define a foot-receiving cavity and an exterior layer at least partially covering an outer side of the base layer. The base layer may also be referred to herein as an inner layer, and the exterior layer may be referred to as an outer layer. The exterior layer may define a first aperture and a second aperture both in a forefoot region of the exterior layer. The second aperture may be rearward of the first aperture. The upper may further include a first strap and a second strap, also referred to herein as anchoring straps. Each of the first strap and the second strap may have a central portion, a front branch, and a rear branch. For example, each strap may have an inverted Y shape. More specifically, the central portion, the front branch and the rear branch of the first strap may form a shape of an inverted Y, and the central portion, the front branch and the rear branch of the second strap may form a shape of an inverted Y. The front branch and the rear branch may be disposed between the outer side of the base layer and the exterior layer. The front branch may extend forward from the central portion to a lower extent of the base layer and the rear branch may extend rearward from the central portion to the lower extent of the base layer. The first and the second straps may be disposed so that the front branch of the second strap crosses the rear branch of the first strap and is disposed forward of the rear branch of the first strap at the lower extent of the base layer. In this manner, the front branch of the second strap and the rear branch of the first strap form an X where they cross one another, enhancing lateral support and dispersing of lateral loads as discussed herein. A lower end of the front branch of the first strap, a lower end of the rear branch of the first strap, and a lower end of the front branch of the second strap may be positioned in the forefoot region, and a lower end of the rear branch of the second strap may be positioned in a midfoot region of the upper. The exterior layer may be transparent or translucent where it overlays the straps so that the relative placement of the straps and their front and rear branches is visible from the exterior of the footwear. For example, a portion of the exterior layer overlaying the first strap and the second strap may be a translucent stretch woven material.

The central portion of the first strap may extend through the first aperture and define a first loop configured to receive a lace, and the central portion of the second strap may extend through the second aperture and define a second loop configured to receive the lace. Tightening of the lace spreads forces through the straps to the sole structure. Because the front and rear branches diverge from the central portion of each strap, the upper is tightened against the foot from the forward extent of the front branch of the first strap to the rear extent of the rear branch of the second strap. The straps may be an inextensible material to provide greater lockdown of the layers of the upper (e.g., the base layer and the exterior layer) against stretching or side movement at the straps under lateral loads, especially when used in combination with a lace that is generally non-stretch or inextensible. As used herein, a lateral load is a transverse load, and may have an outward component either toward the medial side or toward the lateral side of the footwear. Additionally, each of the first strap and the second strap may have a width and a thickness, and the width may be at least three times greater than the thickness.

In one or more alternative configurations, each strap is generally X-shaped and may be assembled within the footwear to have an inverted Y shape at an outer side of the base layer, and an inverted Y shape at an inner side of the base layer. For example, the first strap and the second strap may each include an inner front branch and an inner rear branch extending from the central portion and disposed at an inner side of the base layer, with the inner front branch symmetrical with the front branch disposed at the outer side of the base layer and the inner rear branch symmetrical with the rear branch disposed at the outer side of the base layer. Each strap is thus effectively doubled over, providing even greater lateral support.

In an implementation, the first aperture, the second aperture, the first strap, and the second strap may be disposed at a medial side of the base layer with the first loop and the second loop disposed at a throat opening defined by the base layer. In another implementation, the first aperture, the second aperture, the first strap, and the second strap may be disposed at a lateral side of the base layer with the first loop and the second loop disposed at a throat opening defined by the base layer. In still another implementation, straps and apertures may be disposed at both the medial side and the lateral side of the base layer. In such an implementation, for clarity, the straps and apertures at the lateral side are referred to as first and second straps and first and second apertures, and the straps and apertures at the medial side are referred to as third and fourth straps and third and fourth apertures. For example, the exterior layer may further define a third aperture and a fourth aperture both disposed at a medial side of the base layer in the forefoot region of the base layer with the fourth aperture rearward of the third aperture. The upper may further comprise a third strap and a fourth strap, each including a central portion, a front branch, and a rear branch, the front branch and the rear branch disposed between the base layer and the exterior layer, the front branch extending forward from the central portion to a lower extent of the base layer, and the rear branch extending rearward from the central portion to the lower extent of the base layer. The central portion of the third strap may extend out from between the base layer and the exterior layer through the third aperture and may define a third loop configured to receive the lace. The central portion of the fourth strap may extend out from between the base layer and the exterior layer through the fourth aperture and may define a fourth loop configured to receive the lace. The front branch of the fourth strap may cross the rear branch of the third strap and may be disposed forward of the rear branch of the third strap at the lower extent of the base layer.

In one or more configurations, an article of footwear may comprise a sole structure and an upper. The upper may include an inner layer and an outer layer. The inner layer may be secured at a lower extent to the sole structure and may define a foot-receiving cavity. The outer layer may at least partially cover an outer side of the inner layer at a forefoot region of the upper and may include a first aperture and a second aperture. The upper may further comprise a first anchoring strap and a second anchoring strap both having a central portion and a front branch and a rear branch. The front branch and the rear branch may diverge from the central portion and extend downward between the inner layer and the outer layer and be secured at the sole structure. For example, the upper, including the inner and outer layers and the anchoring straps may be secured to the sole structure, defining a biteline. The front branch of the second anchoring strap may cross the rear branch of the first anchoring strap and be disposed forward of the rear branch of the first anchoring strap at the sole structure. The central portion of the first anchoring strap may emerge from between the inner layer and the outer layer through the first aperture and define a first loop. The central portion of the second anchoring strap may emerge from between the inner layer and the outer layer through the second aperture and define a second loop. A lace may be engaged with both the first loop and the second loop.

In one or more configurations, a portion of the sole structure may extend upward on an outer side of the outer layer and above a biteline between the upper and the sole structure such that the portion overlies and is laterally outward of one or both of the anchoring straps. For example, the midsole may form a peaked portion that is disposed laterally outward of both the upper and at least a portion of one or both of the straps to further fortify the upper against transverse loading.

The above features and advantages and other features and advantages of the present teachings are readily apparent from the following detailed description of the modes for carrying out the present teachings when taken in connection with the accompanying drawings.

Figure 5:
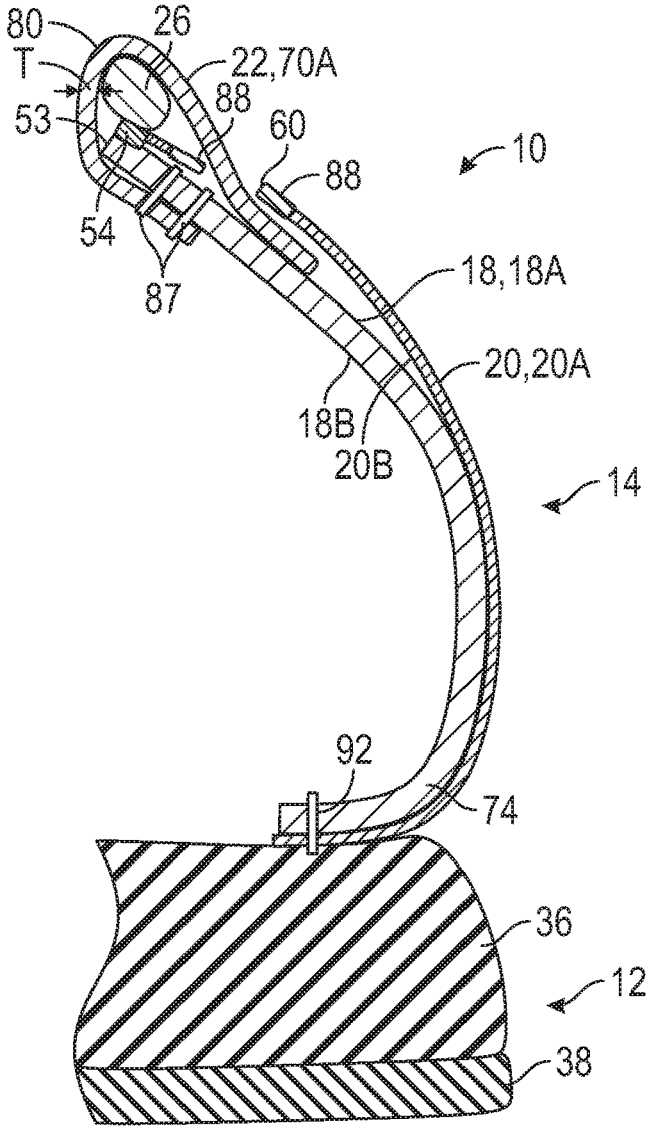
FIG. 5 is a fragmentary sectional view of the article of footwear taken at lines 5-5 in FIG. 3 showing a first option of affixing the first strap to an inner layer of the upper and showing the upper secured to the sole structure.

Referring to the drawings, wherein like reference numbers refer to like components, FIG. 1 shows an article of footwear 10 that has a sole structure 12 and an upper 14 secured to the sole structure 12. The upper 14 forms a foot-receiving cavity 16 configured to receive a foot (not shown). When the foot is positioned within the foot-receiving cavity 16 of the footwear 10, it is supported on a foot-facing surface of the sole structure 12. The upper 14 includes multiple layers 18, 20 and anchoring straps 22, 24, portions of which are between the layers. For example, the upper 14 includes a base layer 18 and an exterior layer 20 overlying the base layer 18 in FIG. 1. The exterior layer 20 may be transparent or translucent so that the base layer 18 and straps 22, 24 are visible from the exterior of the footwear 10. The base layer 18 is best shown in FIG. 5. The anchoring straps 22, 24 engage with a lace 26 as described herein to form part of a closure system 28 configured as described herein to tighten and secure the base layer 18 around the foot.

The footwear 10 illustrated herein is depicted as athletic footwear configured for sports such as basketball, but the footwear 10 is not limited to basketball shoes or other sports shoes. The features of the article of footwear 10 may also be used in footwear for various other sports such as but not limited to running, tennis, football, soccer, etc. or in other types of footwear, such as in an article of footwear that is a leisure shoe, a dress shoe, a work shoe, a sandal, a slipper, a boot, or any other category of footwear.

The footwear 10 may be divided into a forefoot region 30, a midfoot region 32, and a heel region 34 which are also the forefoot region, the midfoot region, and the heel region, respectively, of the sole structure 12 and the upper 14. The forefoot region 30 generally includes portions of the article of footwear 10 corresponding with the toes and the joints connecting the metatarsals with the phalanges. The midfoot region 32 generally includes portions of the article of footwear 10 corresponding with the arch area and instep of the foot, and the heel region 34 corresponds with rear portions of the foot, including the calcaneus bone. The forefoot region 30, the midfoot region 32, and the heel region 34 are not intended to demarcate precise areas of the footwear 10, but are instead intended to represent general areas of the footwear 10 to aid in the following discussion.

The sole structure 12 includes a midsole 36 and an outsole 38, and may include other components and layers, such as an insole. The midsole 36 may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, the midsole 36 may incorporate fluid-filled chambers, plates, moderators, or other elements that further attenuate forces, enhance stability, or influence the motions of the foot. The midsole 36 may be a single, one-piece midsole, or could be multiple components integrated as a unit. In some embodiments, the midsole 36 may be integrated with the outsole 38 as a unisole.

The midsole 36 may include a foamed polymeric material and may be at least partially a polyurethane (PU) foam, a polyurethane ethylene-vinyl acetate (EVA) foam, and may include heat-expanded and molded EVA foam pellets. The foamed polymeric material may include one or more polymers. The one or more polymers may include an elastomer, including a thermoplastic elastomer (TPE). The one or more polymers may include aliphatic polymers, aromatic polymers, or mixture of both. In one example, the one or more polymers may include homopolymers, copolymers (including terpolymers), or mixtures of both. The copolymers may be random copolymers, block copolymers, alternating copolymers, periodic copolymers, or graft copolymers, for instance. The one or more polymers may include olefinic homopolymers or copolymers or a mixture of olefinic homopolymers and copolymers. Examples of olefinic polymers include polyethylene (PE) and polypropylene (PP). For example, the PE may be a PE homopolymer such as a low density PE or a high density PE, a low molecular weight PE or an ultra-high molecular weight PE, a linear PE or a branched chain PE, etc. The PE may be an ethylene copolymer such as, for example, an ethylene-vinyl acetate (EVA) copolymer, an ethylene-vinyl alcohol (EVOH) copolymer, an ethylene-ethyl acrylate copolymer, an ethylene-unsaturated mono-fatty acid copolymer, etc. The one or more polymers may include a polyacrylate such as a polyacrylic acid, an ester of a polyacrylic acid, a polyacrylonitrile, a polyacrylic acetate, a polymethyl acrylate, a polyethyl acrylate, a polybutyl acrylate, a polymethyl methacrylate, a polyvinyl acetate, etc., including derivatives thereof, copolymers thereof, and any mixture thereof, in one example. The one or more polymers may include an ionomeric polymer. The ionomeric polymer may be a polycarboxylic acid or a derivative of a polycarboxylic acid, for instance. The ionomeric polymer may be a sodium salt, a magnesium salt, a potassium salt, or a salt of another metallic ion. The ionomeric polymer may be a fatty acid modified ionomeric polymer. Examples of ionomeric polymers include polystyrene sulfonate, and ethylene-methacrylic acid copolymers. The one or more polymers may include a polycarbonate. The one or more polymers may include a fluoropolymer. The one or more polymers may include a polysiloxane. The one or more polymers may include a vinyl polymer such as polyvinyl chloride (PVC), polyvinyl acetate, polyvinyl alcohol, etc. The one or more polymers may include a polystyrene. The polystyrene may be a styrene copolymer such as, for example, an acrylonitrile butadiene styrene (ABS), a styrene acrylonitrile (SAN), a styrene ethylene butylene styrene (SEBS), a styrene ethylene propylene styrene (SEPS), a styrene butadiene styrene (SBS), etc. The one or more polymers may include a polyamide (PA). The PA may be a PA 6, PA 66, PA 11, or a copolymer thereof. The polyester may be an aliphatic polyester homopolymer or copolymer such as polyglycolic acid, polylactic acid, polycaprolactone, polyhydroxybutyrate, and the like. The polyester may be a semi-aromatic copolymer such as polyethylene terephthalate (PET) or polybutylene terephthalate (PBT). The one or more polymers may include a polyether such as a polyethylene glycol or polypropylene glycol, including copolymers thereof. The one or more polymers may include a polyurethane, including an aromatic polyurethane derived from an aromatic isocyanate such as diphenylmethane diisocyanate (MDI) or toluene diisocyanate (TDI), or an aliphatic polyurethane derived from an aliphatic isocyanate such as hexamethylene diisocyanate (HDI) or isophone diisocyanate (IPDI), or a mixture of both an aromatic polyurethane and an aliphatic polyurethane.

The foamed polymeric material may be a chemically foamed polymeric material, which is foamed using a chemical blowing agent that forms a gas when heated. For example, the chemical blowing agent can be an azo compound such as adodicarbonamide, sodium bicarbonate, or an isocyanate. Alternatively or additionally, the foamed polymeric material may be a physically foamed polymeric material, which is foamed using a physical blowing agent which changes phase from a liquid or a supercritical fluid to a gas due to changes in temperature and/or pressure. In addition to the one or more polymers, the polymeric material may further include one or more fillers such as glass fiber, powdered glass, modified or natural silica, calcium carbonate, mica, paper, wood chips, modified or natural clays, modified or unmodified synthetic clays, talc, etc. Similarly, the polymeric material optionally may further include one or more colorants, such as pigments or dyes. Other components of the polymeric material may include processing aids, ultra-violet light absorbers, and the like.

The foamed polymeric material may be a crosslinked foamed polymeric material, i.e., a foamed material in which covalent crosslinking bonds exist between at least a portion of the one or more polymers. A crosslinked foamed polymeric material can be formed by including a crosslinking agent in the polymeric material used to form the foam. The crosslinking agent can be a peroxide-based crosslinking agent such as dicumyl peroxide. Alternatively, the foamed polymeric material can be an uncrosslinked foamed polymeric material which has thermoplastic properties. The foamed polymeric material may be an elastomeric foamed material.

The outsole 38 may be one-piece, or may be several outsole components, and may be formed from a wear-resistant material that may be textured to impart traction and/or may include traction elements such as cleats secured to the midsole 36. The outsole 38 may comprise an elastomeric material that may be a thermoplastic elastomeric material or a thermoset elastomeric material. The elastomeric material may be a foamed elastomeric material, or an unfoamed elastomeric material. In particular examples, due to their greater tensile strength, unfoamed elastomeric materials may be used to form the elastic component(s). The elastomeric material may be a crosslinked rubber material, such as a sulfur or peroxide-cured rubber material.

The elastomeric material may include one or more elastomeric polymers. The one or more elastomeric polymers may include an elastomeric polyurethane, an elastomeric polyester, an elastomeric polyether, an elastomeric polyamide, an elastomeric polyolefin, or any combination thereof. The one or more elastomeric polymers may include a thermoplastic polyurethane (TPU). The one or more elastomeric polymers may include a polyether-polyurea copolymer.

The one or more elastomeric polymers may include a rubber. The rubber may be a natural rubber, or a synthetic rubber, or a combination of both. Examples of types of rubbers include butadiene rubber, styrene-butadiene (SBR) rubber, butyl rubber, isoprene rubber, urethane rubber, nitrile rubber, neoprene rubber, ethylene propylene diene monomer (EPDM) rubber, ethylene-propylene rubber, urethane rubber, polynorbornene rubber, methyl methacrylate butadiene styrene (MBS) rubber, styrene ethylene butylene (SEBS) rubber, silicone rubber, urethane rubber, and mixtures thereof. The rubber compound may be a virgin material, a regrind material, and mixtures thereof.

The elastomeric material may further comprise one or more additives independently selected from the group of crosslinking agents, plasticizers, mold release agents, lubricants, antioxidants, flame retardants, dyes, pigments, reinforcing and non-reinforcing fillers, fiber reinforcements, and light stabilizers.

Figure 2:
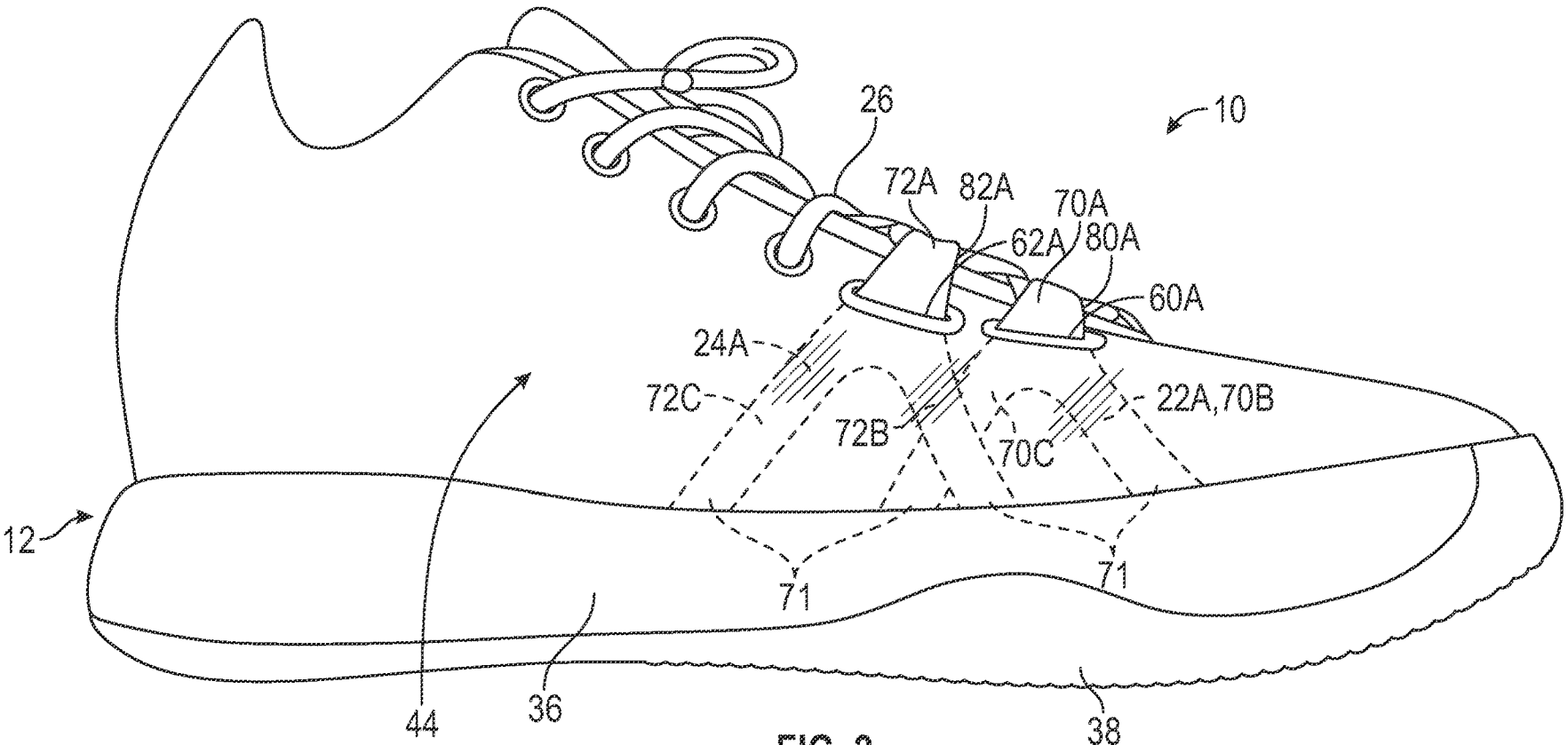
FIG. 2 is a medial side view of the article of footwear of FIG. 1.

The footwear 10 has a lateral side 42 (shown in FIG. 1) and a medial side 44 (shown in FIG. 2). The lateral side 42 and medial side 44 extend through each of the forefoot region 30, the midfoot region 32, and the heel region 34, and correspond with opposite sides of the article of footwear 10, each falling on an opposite side of a longitudinal midline LM of the article of footwear 10, indicated in FIG. 3. The medial side 44 is thus considered opposite to the lateral side 42.

As shown in FIG. 2, the upper 14 also includes anchoring straps 22A, 24A disposed at the medial side 44. The anchoring straps 22, 24, 22A, and 24A may also be referred to herein simply as straps. The strap 22 may be referred to as a first strap, and the strap 24 may be referred to as a second strap. The strap 22A may also be referred to as a first strap and the strap 24A may also be referred to as a second strap. For clarity in the discussion to differentiate from the first strap 22, the strap 22A may be referred to as a third strap. For clarity in the discussion to differentiate from the second strap 24, the strap 24A may be referred to as a fourth strap. Discussion of the configuration, properties, or features of the first strap 22 applies equally to the strap 22A. Discussion herein of the configuration, properties, or features of the second strap 24 applies equally to the strap 24A. It should be appreciated that embodiments of footwear disclosed herein may include only the straps 22, 24 on the lateral side 42, or only the straps 22A, 24A on the medial side 44, or may include all of the straps 22, 24, 22A, and 24A.

The upper 14 may be a variety of materials, such as leather, textiles, polymers, cotton, foam, composites, etc. For example, the base layer 18 may be a material that has greater elasticity, greater breathability, or both greater elasticity and greater breathability than the material or materials of the straps 22, 24, 22A, and 24A in order to aid with foot insertion and comfort. The base layer 18 may be a polymeric material capable of providing elasticity. In non-limiting examples, the base layer 18 may be of a braided construction, a knitted (e.g., warp-knitted) construction, or a woven construction.

A tongue 50 may be integrated with or separately secured to the base layer 18. The tongue 50 extends over the instep of the foot and a throat opening 52 (best shown in FIG. 3) that is partially defined by the base layer 18. The throat opening 52 is spanned by the lace 26. Trim 54 secured to the base layer 18 or to the exterior layer 20 may border an edge 53 of the base layer 18 at the throat opening 52. The exterior layer 20 may be relatively thin in comparison to the base layer 18 and may be transparent, translucent, or opaque. For example, the exterior layer 20 may be a translucent stretch woven material.

The anchoring straps 22, 22A, 24, and 24A may be one or more materials that are stiffer than the base layer 18 and the exterior layer 20 to enhance the lateral support and lend stability to the foot within the upper 14. The anchoring straps 22, 22A, 24, and 24A may be less elastic than the layers 18, 20 and may be inextensible so that the tightened anchoring straps 22, 22A, 24, and 24A effectively lock down the base layer 18 where the straps 22, 22A, 24, and 24A extend over the outer side 18A of the base layer 18. The base layer 18 may be a first material with a first elasticity, and the anchoring straps 22, 22A, 24, and 24A may be a second material with a second elasticity that is less than the first elasticity. For example, the anchoring straps 22, 22A, 24, and 24A may be suede, leather, composites, a thermoplastic polyurethane, or the like. The closure system (e.g., the straps 22, 22A, 24, and 24A and the lace 26) provides an adjustable, secure fit to tighten the base layer 18 around the foot, to thereby secure the foot relative to the sole structure 12 underlying the upper 14.

It should be appreciated that the upper 14 may include additional layers besides the base layer 18 and the exterior layer 20. For example, there may be intermediate layers between the base layer 18 and the exterior layer 20, or there may be additional layers inward of the base layer 18. In any embodiment, the base layer 18 is inward of the exterior layer 20 in the constructed footwear 10 and the straps 22, 22A, 24, and 24A extend out of apertures 60, 62, 60A, and 62A in the exterior layer 20.

More specifically, the exterior layer 20 at least partially covers the outer side 18A of the base layer 18 in the forefoot region 30 and defines a first aperture 60 and a second aperture 62 at the lateral side 42 just below the throat opening 52. The exterior layer 20 also defines apertures 60A, 62A in the forefoot region 30 at the medial side 44 just below the throat opening 52. The apertures 60A, 62A may also be referred to as first and second apertures, respectively, or as third and fourth apertures, respectively. All of the apertures 60, 60A, 62, and 62A are in the forefoot region 30. The second aperture 62 is rearward of the first aperture 60. The aperture 62A is rearward of the aperture 60A. Stated differently, at least a portion of the second aperture 62 is rearward of the first aperture 60 in a direction along the longitudinal midline LM of the footwear 10 and at least a portion of the aperture 62A is rearward of the aperture 60A in a direction along the longitudinal midline LM of the footwear 10 (e.g., toward the heel region 34).

Each of the straps 22, 22A, 24, and 24A includes a central portion, a front branch, and a rear branch. The first strap 22 includes a central portion 70A, a front branch 70B, and a rear branch 70C. The first strap 22 is shown in isolation in FIG. 10. The strap 22A also includes a central portion 70A, a front branch 70B, and a rear branch 70C. The second strap 24 includes a central portion 72A, a front branch 72B, and a rear branch 72C, and is shown in isolation in FIG. 11. The strap 24A also includes a central portion 72A, a front branch 72B, and a rear branch 72C. In each case, the front branch 70B or 72B and the rear branch 70C or 72C is disposed between the outer side 18A of the base layer 18 and the inner side 20B of the exterior layer 20 (indicated in FIG. 5).

As shown in FIG. 1, the front branch 70B extends forward from the central portion 70A to a lower extent 74 of the base layer 18 and the rear branch 70C extends rearward from the central portion 70A to the lower extent 74 of the base layer 18. The front branch 72B extends forward from the central portion 72A to the lower extent 74 of the base layer 18 and the rear branch 72C extends rearward from the central portion 72A to the lower extent 74 of the base layer 18. The straps 22, 24 are thus configured generally as inverted Y shapes. By diverging from the central portion 70A or 72A, the respective branches 70B, 70C and 72B, 72C spread the tightening forces of the lace 26 and the straps 22, 24 over a wider section of the forefoot region 30, thus better conforming the base layer 18 and the sole structure 12 to the foot and avoiding concentrated loading of the forces of the closure system 28 on the sole structure 12 at the biteline 76. By comparison, if the straps 22, 24 were straight without branches (e.g., if the central portion extended straight downward to the sole structure 12), then tightening forces would be localized to a smaller portion of the base layer 18 and the underlying sole structure 12.

The apertures 60, 62 are close enough to one another that the front branch 72B of the second strap 24 crosses over (e.g., overlaps) the rear branch 70C of the first strap 22 and is disposed forward of the rear branch 70C of the first strap 22 at the lower extent 74 of the base layer 18 (e.g., near the biteline 76 where the upper 14 meets the sole structure 12). The order from front to rear of the branches at the lower extent 74 is thus front branch 70B, front branch 72B, rear branch 70C, and rear branch 72C. The crossing front branch 72B and rear branch 70C form an X shape that helps to reinforce the portion of the forefoot region 30 at the crossing branches, dispersing the lateral forces of the foot applied to the upper 14 to both the lace 26 and the sole structure 12 forward and rearward of where the branches cross one another.

Figure 3:
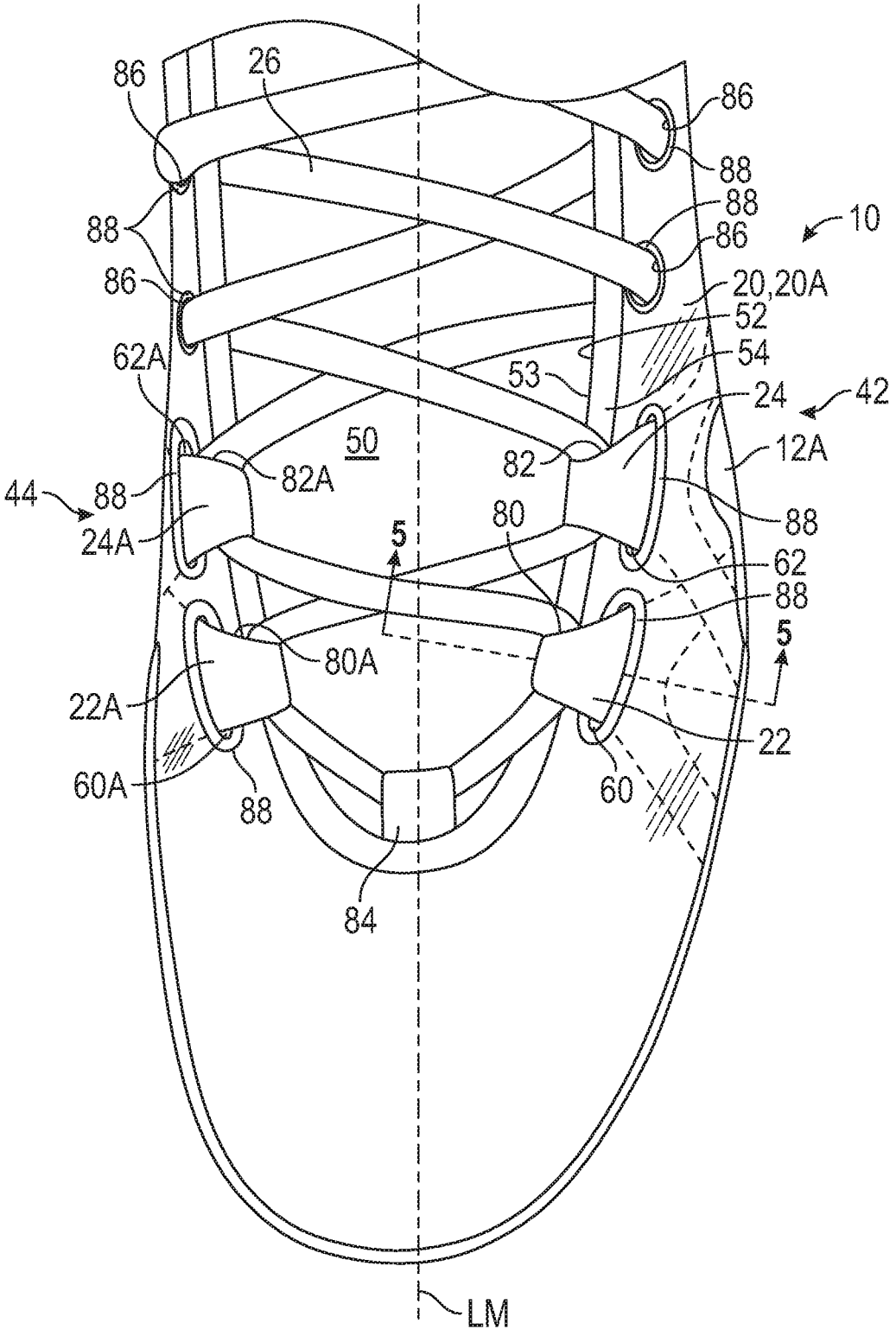
FIG. 3 is a fragmentary plan view of the article of footwear of FIG. 1.

As shown in FIG. 1, a portion 12A of the sole structure 12 extends upward on an outer side 20A of the exterior layer 20 and above the biteline 76 to a peak 12B. The portion 12A is disposed laterally outward of and overlies a portion of one or both of the first anchoring strap 22 and the second anchoring strap 24 as shown in FIGS. 1 and 3. The portion 12A of the sole structure 12 that extends upward to the peak 12B may be the midsole 36 or the outsole 38 or both the midsole 36 and the outsole 38. An overlay 90 that is thicker, denser, or both thicker and denser than the exterior layer 20 may line the exterior layer 20 between the exterior layer 20 and the peaked portion 12A of the sole structure 12.

The central portion 70A or 72A of each anchoring strap 22, 24, 22A, and 24A extends through the respective aperture 60, 62, 60A, or 62A to emerge at the outer side 20A of the exterior layer 20. The central portions 70A, 72A are each sufficiently elongated so that the branches 70B, 70C, 72B, 72C can remain entirely between the base layer 18 and the exterior layer 20 while only the central portions 70A and 72A emerge out from between the base layer 18 and the exterior layer 20 through the apertures 60, 60A, 62, and 62A at the outer side 20A of the exterior layer 20. The central portion 70A of the first strap 22 extends through the first aperture 60 and defines a first loop 80 disposed at the throat opening 52 and configured to receive the lace 26. The central portion 72A of the second strap 24 extends through the second aperture 62 and defines a second loop 82 disposed at the throat opening 52 and configured to receive the lace 26. The central portion 70A of the strap 22A extends through the first aperture 60A and defines a loop 80A (referred to as another first loop or as a third loop) disposed at the throat opening 52 and configured to receive the lace 26. The central portion 72A of the strap 24A extends through the second aperture 62A and defines a loop 82A (referred to as another second loop or as a fourth loop) disposed at the throat opening 52 and configured to receive the lace 26. The first loop 80 is integrally formed by the central portion 70A of the first strap 22. The second loop 82 is an integrally formed by the central portion 72A of the second strap 24. The first loop 80A is integrally formed by the central portion 70A of the strap 22A. The second loop 82A is integrally formed by the central portion 72A of the strap 24A.

As best shown in FIG. 3, the lace 26 extends through the loops 80, 80A, 82, 82A. A lace guide 84 is secured at the front of the throat opening 52 forward of the straps 22, 22A, 24, and 24A and also forms a loop through which the lace 26 passes. The base layer 18 and the overlying exterior layer 20 define eyelets 86 rearward of the apertures 60, 60A, 62, 62A on the lateral and medial sides 42, 44. If the exterior layer 20 does not extend far enough rearward to cover the base layer 18 in the area of the eyelets 86, then the base layer 18 alone defines the eyelets 86. The apertures 60, 60A, 62, and 62A and the eyelets 86 may be reinforced at their perimeters 88 with plastic rings, stitching or otherwise. The lace 26 is thus engaged with the straps 22, 22A, 24, and 24A by extending through the loops 80, 80A, 82, and 82A formed by the central portions 70A, 72A at the outer side 20A of the exterior layer 20 adjacent to the throat opening 52. The lace 26 is shown extending through the lace guide 84 and then crisscrossing from the lateral side 42 to the medial side 44 rearward through the loops 80, 80A, 82, and 82A and eyelets 86. The lace 26 may be threaded through the loops 80, 80A, 82, and 82A and eyelets 86 in another pattern or order than that shown.

Figure 4:
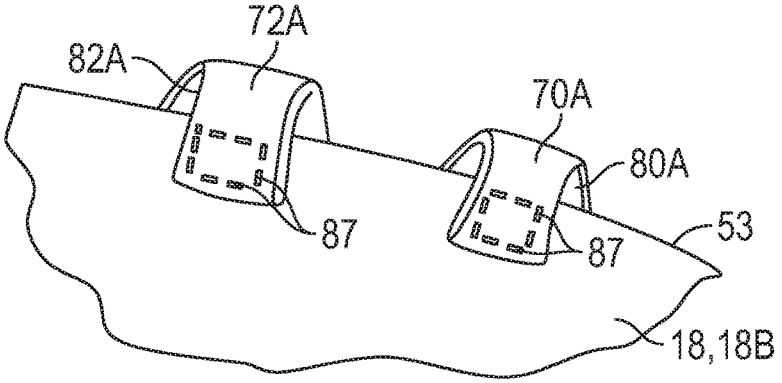
FIG. 4 is a fragmentary view of an inner side of an inner layer of the upper and loops defined by the first and second straps with the lace removed.

FIG. 4 shows the inner side 18B of the base layer 18 at the edge 53 of the base layer 18 that defines the throat opening 52 of FIG. 3. The central portions 70A, 72A are looped downward and secured at their upper ends to the inner side 18B of the base layer 18 to define the first and second loops 80A and 82A. For example, the central portions 70A, 72A may be affixed to the inner side 18B of the base layer 18 with stitches 87 as shown. The lace 26 is not shown in FIG. 4.

FIG. 5 shows the base layer 18 and the exterior layer 20 secured to the sole structure 12 at the lower extent 74 of the base layer 18 by one or more of adhesive, stitching, or thermal bonding. For example an adhesive such as a bonding cement may be applied to the base layer 18, the exterior layer 20 and/or the midsole 36 where they interface. Stitching indicated by stitch 92 may be used in addition to adhesive, or alone. FIG. 5 shows the loop 80 formed by the central portion 70A extending around the edge 53 and secured to the inner side 18B of the base layer 18. The tongue 50 is not shown. The first strap 22 is not affixed to the outer side 18A of the base layer 18.

Figure 11:
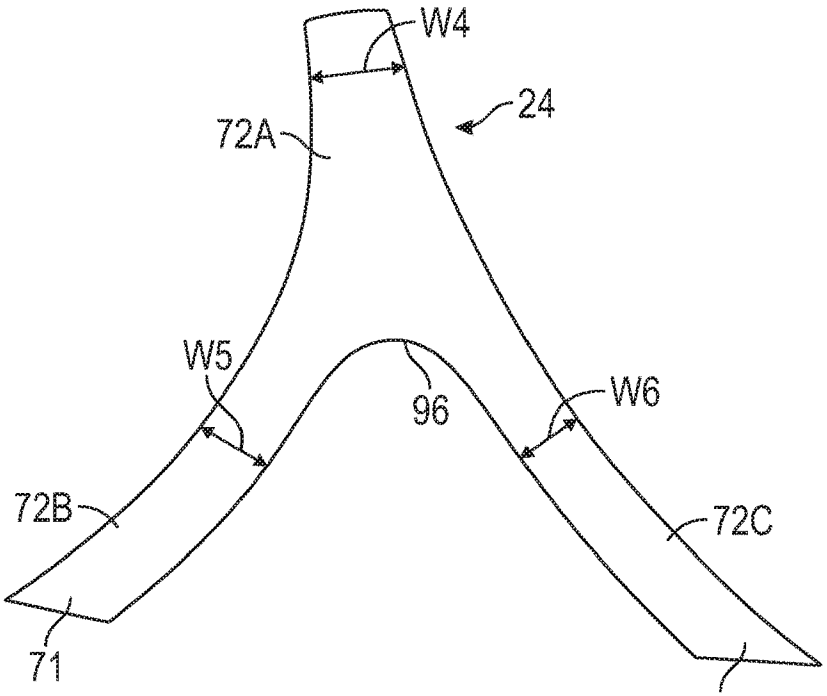
FIG. 11 is an elevation view of an outer side of the second strap prior to assembly in the footwear.
Figure 10:
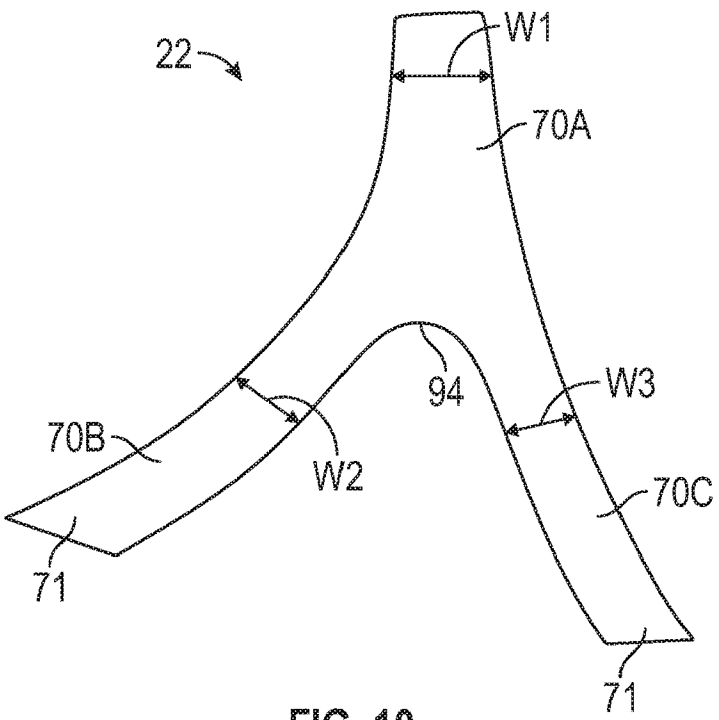
FIG. 10 is an elevation view of an outer side of the first strap prior to assembly in the footwear.

The branches 70B, 70C, 72B, and 72C extend between the base layer 18 and the exterior layer 20 to the lower extent 74. The base layer 18 and the exterior layer 20 and the branches 70B, 70C, 72B, and 72C therebetween are positioned to extend over the foot-facing surface of the midsole 36 near the perimeter of the midsole 36. The lower ends 71 of the branches 70B, 70C, 72B, and 72C are then adhered or stitched to the midsole 36, similar to the securement of the base layer 18 at stitch 92 in the cross-section shown. FIGS. 10 and 11 show lower ends 71 of each of the branches 70B, 70C, 72B, and 72C. Accordingly, the straps 22, 24, 22A, 24A are secured at their lower ends 71 to the midsole 36 by stitching through the base layer 18 and the straps 22, 24, 22A, and 24. The general location of the lower end of each branch 70B, 70C, 72B, and 72C is indicated in FIG. 1 with the lower end 71 of the front branch 70B of the first strap 22, the lower end 71 of the rear branch 70C of the first strap 22, and the lower end 71 of the front branch 72B of the second strap 24 are positioned in the forefoot region 30 of the upper 14 (which is also the forefoot region 30 of the article of footwear 10), and a lower end 71 of the rear branch 72C of the second strap 24 is positioned in the midfoot region 32 of the upper 14 (which is also the midfoot region 32 of the article of footwear 10).

Figure 9:
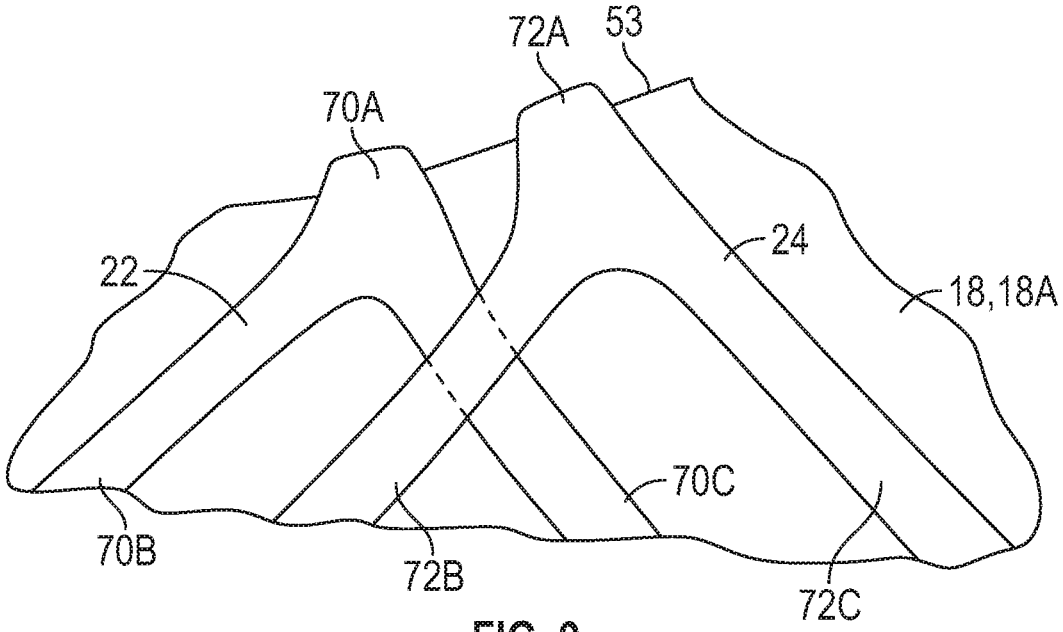
FIG. 9 is a fragmentary view of the outer side of the inner layer of the upper showing the straps unaffixed to the portion of the outer side of the inner layer shown, and with the outer layer of the upper not shown.

Although not visible at the cross-section taken at FIG. 5, as further discussed with respect to FIG. 9, the front branches 70B, 72B and the rear branches 70C, 72C are unaffixed to the base layer 18 along their lengths between the central portions 70A, 72A and the lower extent 74. The front branches 70B, 72B and the rear branches 70C, 72C are also unaffixed to the exterior layer 20 along their lengths between the apertures 60, 62 and the lower extent 74 at which they are secured to the sole structure 12. The central portions 70A, 72A are also unaffixed to the outer side 18A of the base layer 18. Stated differently, in the embodiment shown, the straps 22, 22A, 24, and 24A are affixed only at their lower ends 71 (e.g., to the midsole 36 at the lower extent 74 of the base layer 18 at the midsole 36) and at the inner side 18B of the base layer 18 (e.g., at their central portions 70A, 72A such as with stitches 87 to define the loop 80, 80A, 82, 82A, respectively).

Figure 6:
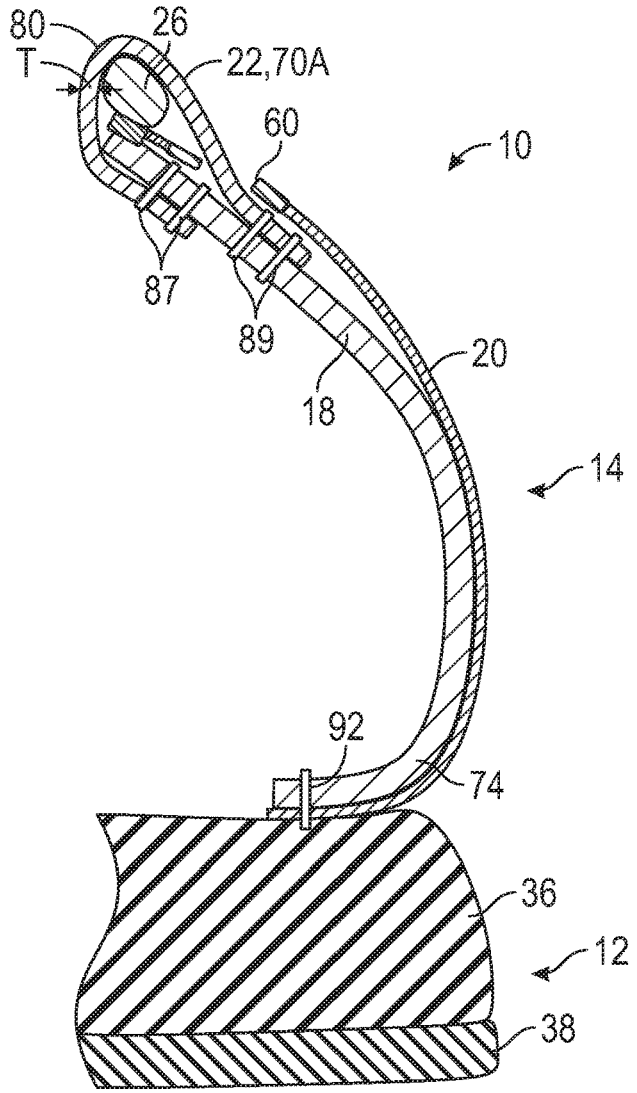
FIG. 6 is a fragmentary sectional view of the article of footwear taken at lines 5-5 in FIG. 3 showing a second option of affixing the first strap to an inner layer of the upper.

Alternatively, the straps 22, 22A, 24, and 24A may also be affixed at other locations in addition to their central portions 70A, 72A and lower ends 71 in some embodiments. For example, FIG. 6 shows another embodiment like that of FIG. 5 in every aspect except that the central portion 70A is also affixed to the outer side 18A of the base layer 18. As shown, the central portion 70A is affixed to the outer side 18A with stitches 89. Alternatively, adhesive may be used to affix the central portion 70A to the outer side 18A. The central portion 72A of the second strap 24 may be affixed to the outer side 18A in a similar manner. Accordingly, in some embodiments, the central portions 70A or 72A may be secured to both the outer side 18A and the inner side 18B of the base layer 18.

Figure 7:
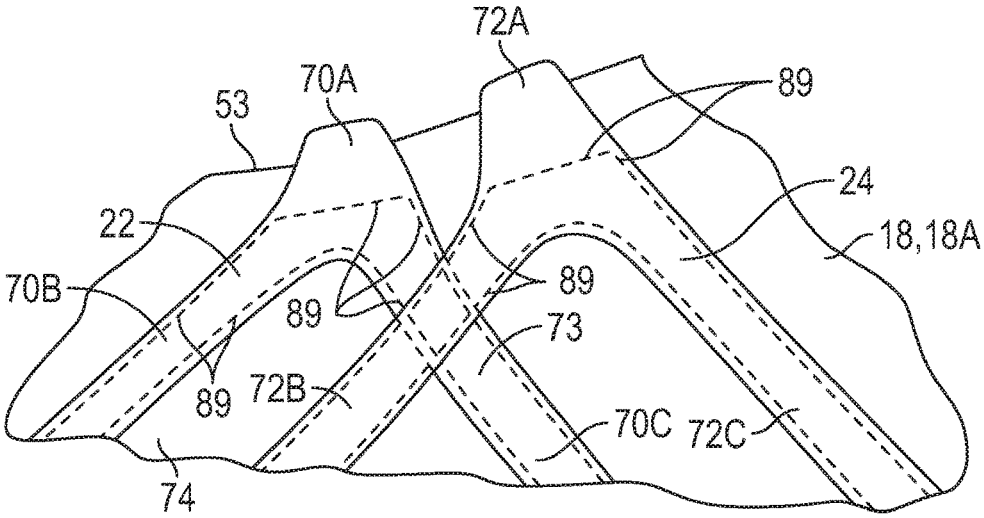
FIG. 7 is a fragmentary view of an outer side of an inner layer of the upper showing one option of affixing the straps to the outer side of the inner layer and with an outer layer of the upper not shown.

FIG. 7 shows another embodiment like the embodiment of FIG. 6 in every aspect except that the front branches 70B, 72B and the rear branches 70C, 72C of the straps 22, 24 are also affixed to the outer side 18A between the lower extent 74 of the base layer 18 and the central portions 70A, 72A with stitches 89. The exterior layer 20 of the upper 14 is not shown in FIG. 7 in order to better show the stitches 89. The lace 26 is also not shown. It is also apparent in FIG. 7 that the front branch 72B of the second strap 24 crosses over the outer side 73 of the rear branch 70C of the first strap 22.

Figure 8:
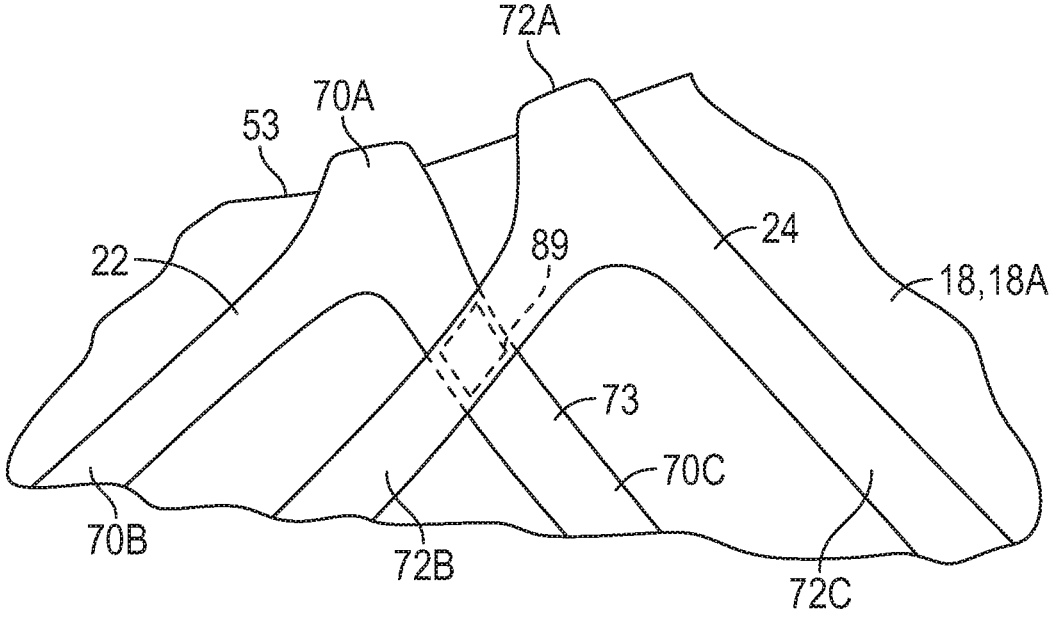
FIG. 8 is a fragmentary view of the outer side of the inner layer of the upper showing one option of affixing the straps to one another at the outer side of the inner layer and with the outer layer of the upper not shown.

FIG. 8 shows another embodiment like that of FIG. 5 in every aspect except that the front branch 72B of the second strap 24 is affixed to the outer side of the rear branch 70C of the first strap 22 with stitches 89 where it crosses over the rear branch 70C. The stitches 89 may extend into the base layer 18 to secure both straps 22, 24 to the base layer 18, or may only extend through the straps 22, 24 to secure the straps 22, 24 to one another.

FIG. 9 is a fragmentary view of the outer side 18A of base layer 18 showing the straps 22, 24 unaffixed between their ends 71 (not shown) and their central portions 70A, 72A to the portion of the outer side 18A. The exterior layer 20 of the upper 14 and the lace 26 not shown. As described with respect to FIG. 5, the central portions 70A, 72A may be secured to the inner side 18B of the base layer 18 where they loop over the edge 53.

FIG. 10 is an elevation view of an outer side of the first strap 22 prior to assembly in the footwear 10, and FIG. 11 is an elevation view of an outer side of the second strap 24 prior to assembly in the footwear 10. As can be seen in FIG. 10. The strap 22 forms the shape of an inverted Y. More particularly, the central portion 70A is the stem of the inverted Y and the front and rear branches 70B, 70C are the legs of the inverted Y. The central portion 70A is sufficiently long to allow it to form a loop 80 as in FIG. 5 and secure to the inner side 18B of the base layer 18 with enough room for the lace 26 to extend through the loop 80. Additionally, the central portion 70A is sufficiently long that the vertex 94 where the lower edges of the branches 70B, 70C merge remains below the first aperture 60 in the assembled footwear 10, as shown in FIG. 1. Similarly, the strap 24 forms the shape of an inverted Y. The central portion 72A is the stem of the inverted Y and the front and rear branches 72B, 72C are the legs of the inverted Y. The central portion 72A of the second strap 24 shown in FIG. 11 is sufficiently long to allow it to form a loop 82 and secure to the inner side 18B of the base layer 18 with enough room for the lace 26 to extend through the loop 82. The central portion 72A is also sufficiently long that the vertex 96 where the lower edges of the branches 72B, 72C merge remains below the second aperture 62 in the assembled footwear 10, as shown in FIG. 1. Configuring the straps 22, 24 in this manner such that the entirety of the front branches 70B, 72B and the rear branches 70C, 72C remain below the apertures 60, 62 avoids any inadvertent twisting or snagging of the branches as might occur if they were exposed at the exterior of the footwear 10.

The straps 22, 24 are of uniform thickness as represented by thickness T in the cross-section of FIG. 5. Each of the central portions 70A, 72A and the branches 70B, 70C, 72B, and 72C are many times wider than they are thick, as represented by the respective widths W1, W2, and W3 of the strap 22 in FIG. 11, each of which is greater than the thickness T of the strap 22. The strap 24 may have the same thickness T and respective widths W4, W5, and W6 that are the same or different than widths W1, W2, and W3 and that are many times greater than the thickness T. For example, the straps 22, 24 may each be at least three times wider than they are thick. Each of the widths W1, W2, W3, W4, W5, and W6 is measured perpendicular to a midline along the length of the respective portion or branch. By configuring the straps 22, 24 to be relatively thin and flat, they provide greater surface area for the foot to react against when lateral forces are exerted on the straps 22, 24.

Figure 13:
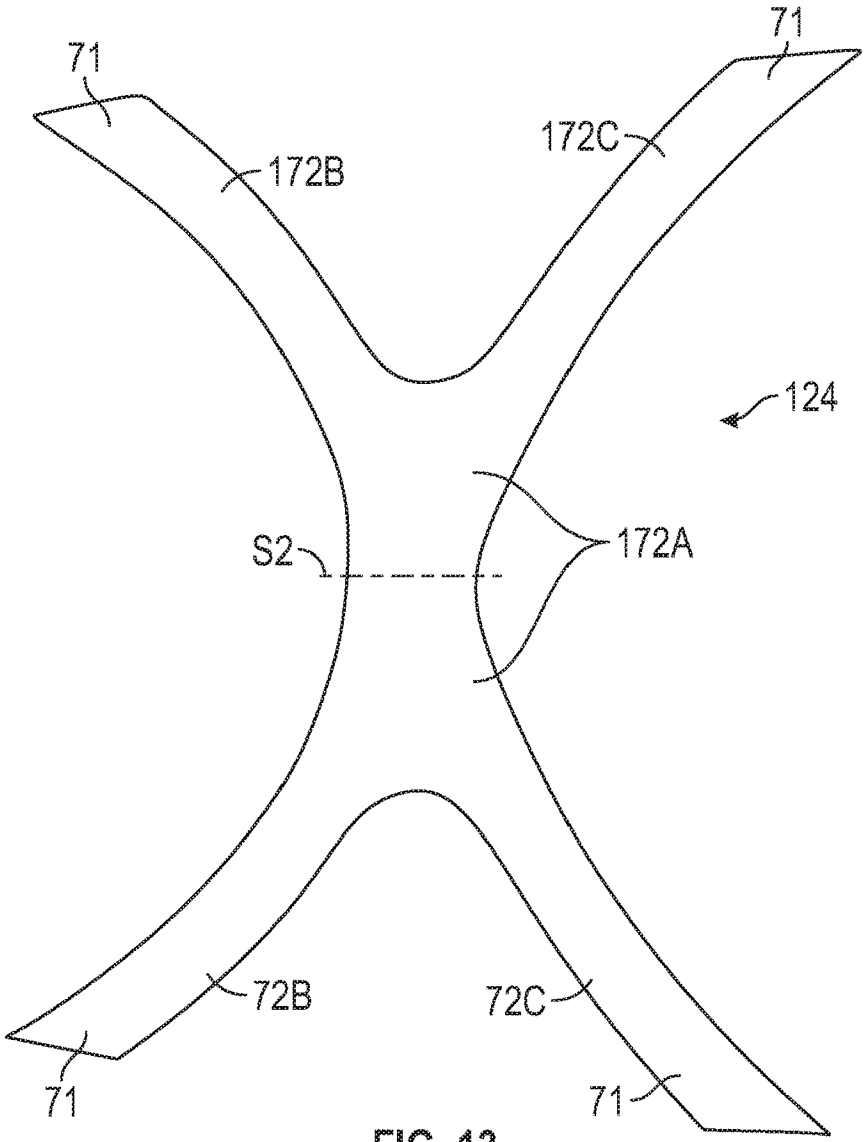
FIG. 13 is an elevation view of an outer side of an alternative second strap prior to assembly in the footwear.
Figure 12:
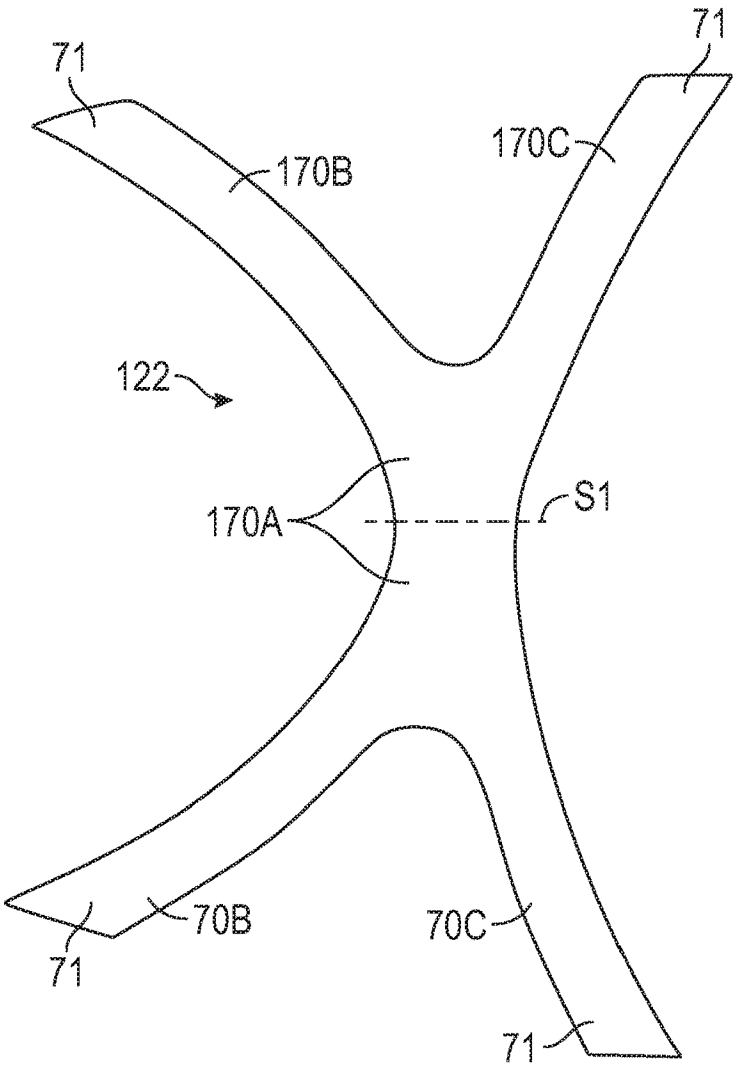
FIG. 12 is an elevation view of an outer side of an alternative first strap prior to assembly in the footwear.
Figure 14:
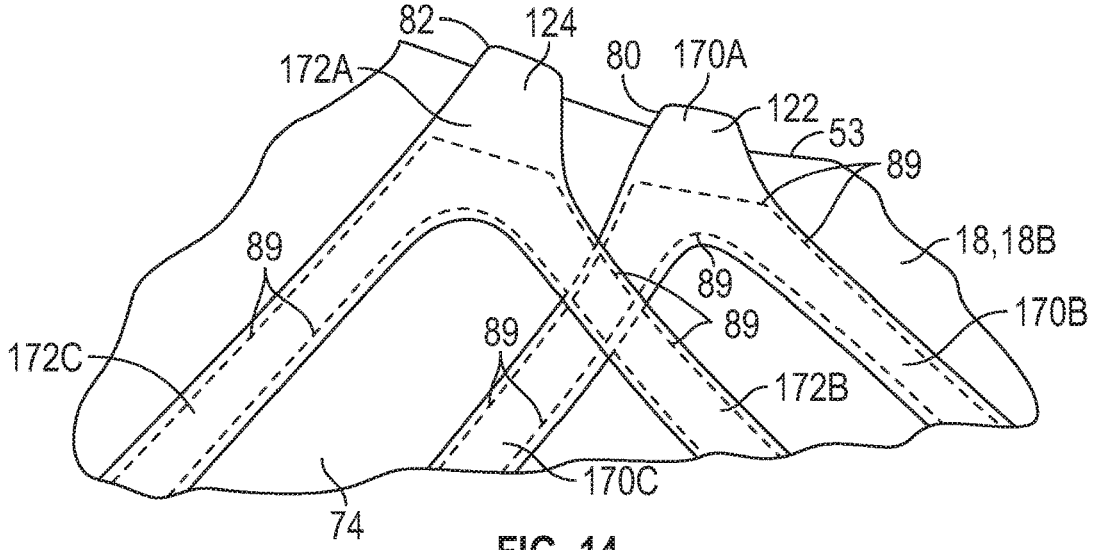
FIG. 14 is a fragmentary view of an inner side of the inner layer and the first and second straps of FIGS. 12 and 13 showing one option of affixing the straps to the inner side of the inner layer.

FIG. 12 is an elevation view of an outer side of an alternative first strap 122 prior to assembly in the footwear 10, and FIG. 13 is an elevation view of an outer side of an alternative second strap 124 prior to assembly in the footwear 10. The first strap 122 and the second strap 124 are each configured to be symmetrical about a line of symmetry and generally X-shaped so that they may effectively be doubled over with one portion extending on the outer side 18A of the base layer 18, and another symmetrical portion extending along the inner side 18B of the base layer 18. Because they are symmetrical, the portion on the inner side is aligned with the portion on the outer side. For example, the first strap 122 includes an inner front branch 170B and an inner rear branch 170C extending from a central portion 170A. The central portion 170A is symmetrical about a line of symmetry S1 so that half of the central portion 170A is on one side of the line of symmetry S1 and the other half is on an opposite side of the line of symmetry S1. The inner front branch 170B is symmetrical with the front branch 70B, and the inner rear branch 170C is symmetrical with the rear branch 70C. When the first strap 122 is assembled in the article of footwear 10, the inner front branch 170B and the inner rear branch 170C are disposed at the inner side 18B of the base layer 18 as shown in FIG. 14, with the front branch 70B and the rear branch 70C disposed at the outer side 18A similarly as shown with respect to strap 22 in FIG. 1. Accordingly, the front branch 70B is also referred to as an outer front branch, and the rear branch 70C is also referred to as an outer rear branch. The lines of symmetry S1 will be approximately at the top of the first loop 80 defined by the central portion 170A so that the portion of the strap 122 at the inner side 18B of the base layer 18 forms an inverted Y shape, and the portion of the strap 122 at the outer side 18A of the base layer 18 form an inverted Y shape.

Similarly, the second strap 124 of FIG. 13 includes an inner front branch 172B and an inner rear branch 172C extending from a central portion 172A. The central portion 172A is symmetrical about the line of symmetry S2 so that half of the central portion 172A is on one side of the line of symmetry S2 and the other half is on an opposite side of the line of symmetry S2. The inner front branch 172B is symmetrical with the front branch 72B, and the inner rear branch 172C is symmetrical with the rear branch 72C. When the second strap 124 is assembled in the article of footwear 10, the inner front branch 172B and the inner rear branch 172C are disposed at the inner side 18B of the base layer 18 as shown in FIG. 14, with the front branch 72B and the rear branch 72C disposed at the outer side 18A similarly as shown with respect to strap 24 in FIG. 1. Accordingly, the front branch 72B is also referred to as an outer front branch, and the rear branch 72C is also referred to as an outer rear branch. The line of symmetry S2 will be approximately at the top of the second loop 82 defined by the central portion 172A so that the portion of the strap 124 at the inner side 18B of the base layer 18 forms an inverted Y shape, and the portion of the strap 124 at the outer side 18A of the base layer 18 form an inverted Y shape. The first strap 122 and the second strap 124 extend over the edge 53 of the base layer 18 at the throat opening 52 of FIG. 3 and along the inner side 18B of the base layer 18 (e.g., in the foot-receiving cavity 16) to the lower extent 74 of the base layer 18. Another inner layer (not shown), such as a lining may extend over the inner front branches 170B, 172B and the inner rear branches 170C, 172C, or the inner front branches 170B, 170C and the inner rear branches 172B, 172C may be exposed in the foot-receiving cavity 16.

Similar to the branches 70B, 70C, 72B, and 72C that are disposed at the outer side 18A, there are many options for affixing the inner front branches 170B, 172B and the inner rear branches 170C, 172C. FIG. 14 shows the central portions 170A, 172A affixed to the inner side 18B of the base layer 18 with stitches 89. The inner front branches 170B, 172B and the inner rear branches 170C, 172C are also affixed to the inner side 18B between the lower extent 74 of the base layer 18 and the central portions 170A, 172A with stitches 89. These may be the same stitches that stitch the branches 70B, 70C, 72B, and 72C at the outer side 18A. In other words, the stitches 89 may extend through both sets of symmetrical branches and through the base layer 18. The lace 26 is also not shown. It is also apparent in FIG. 14 that the inner front branch 172B of the second strap 124 crosses over the outer side of the inner rear branch 170C of the first strap 122. Alternatively, instead of stitches 89, adhesive may be used to affix the central portions 170A, 172A and the inner branches 170B, 170C, 172B, and 172C to the outer side 18A.

Figure 15:
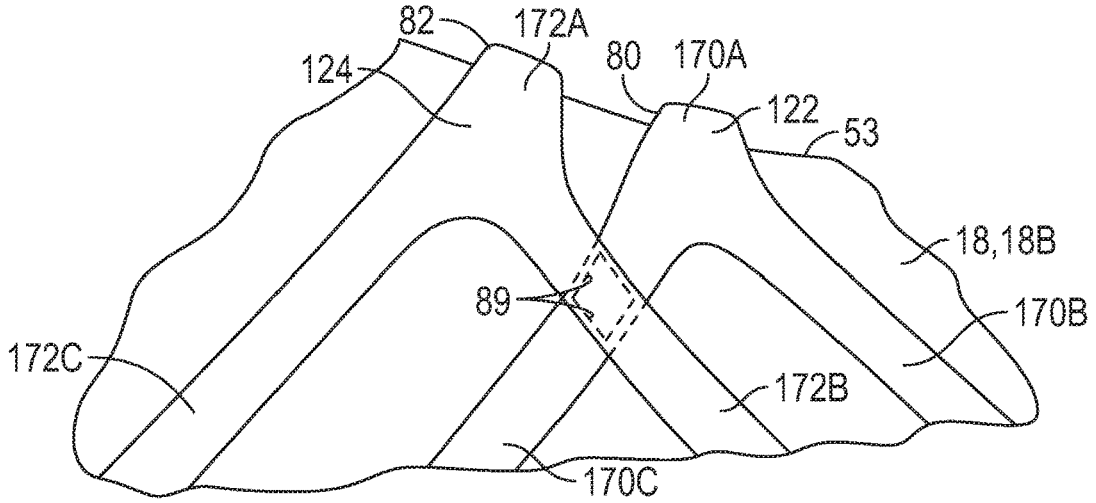
FIG. 15 is a fragmentary view of the inner side of the inner layer and the first and second straps of FIGS. 12 and 13 showing one option of affixing the straps to one another at the inner side of the inner layer.

FIG. 15 shows another embodiment like that of FIG. 14 in every aspect except that the inner branches are secured at stitches 89 shown in FIG. 15 but are otherwise unaffixed to the base layer 18 except at their ends (not shown in the fragmentary view) where they are affixed to the lower extent 74 of the base layer 18 and to the midsole 36. More specifically, the inner front branch 172B of the second strap 124 is affixed to the outer side of the inner rear branch 170C of the first strap 122 with stitches 89 where it crosses over the inner rear branch 170C. The stitches 89 may extend into the base layer 18, or may only secure the straps 122, 124 to one another.

Figure 16:
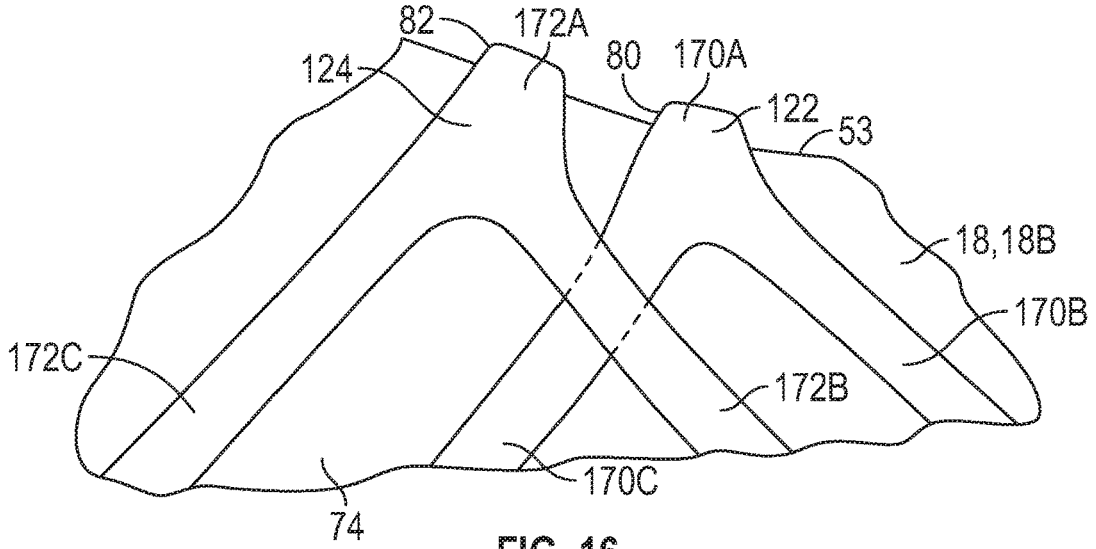
FIG. 16 is a fragmentary view of the inner side of the inner layer with the first and second straps of FIGS. 12 and 13 unaffixed to the portion of the inner layer shown.

FIG. 16 is a fragmentary view of the inner side 18B of base layer 18 showing the straps 122, 124 unaffixed to the portion of the inner side 18B shown, and with the lace 26 not shown. In such an embodiment, the straps 122, 124 may be unaffixed to the outer side 18A, unaffixed to the inner side 18B, and secured only at their ends (not shown) to the lower extent of the base layer 18 and to the midsole 36.

Figure 17:
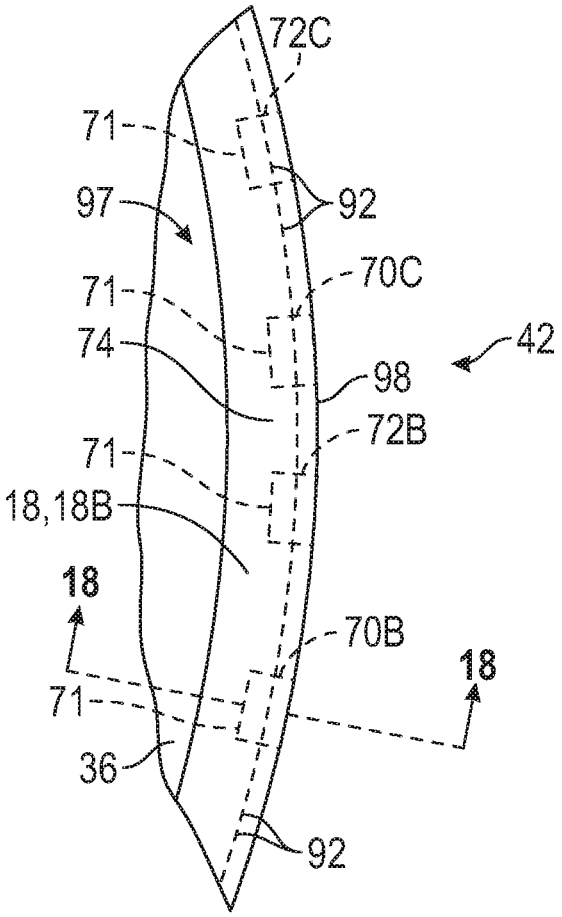
FIG. 17 is a fragmentary plan view of the upper including the straps of FIGS. 10 and 11 secured to the sole structure.
Figure 18:
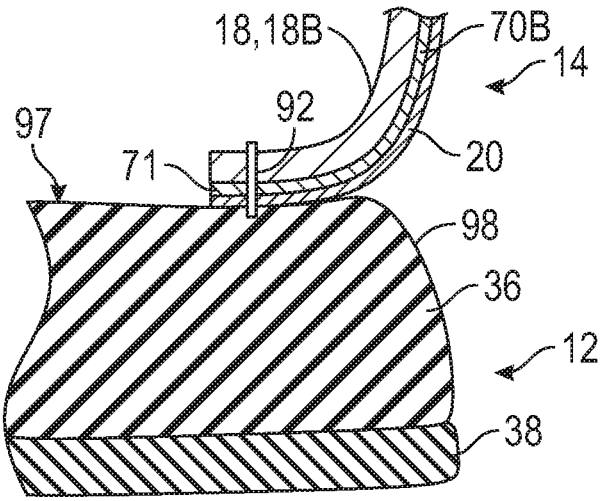
FIG. 18 is a cross-sectional view of the upper secured to the sole structure taken at lines 18-18 in FIG. 17.

FIG. 17 is a fragmentary plan view of the upper 14 including the straps 22, 24 of FIGS. 10 and 11 secured to the midsole 36. The base layer 18 and the exterior layer 20 and the branches 70B, 70C, 72B, and 72C therebetween are positioned to extend over the foot-facing surface 97 of the midsole 36 near the perimeter 98 of the midsole 36. The lower ends 71 of the branches 70B, 70C, 72B, and 72C are stitched to the midsole 36 with stitches 92. The stitching 92 extends through the base layer 18 and the straps 22 and 24 and into the midsole 36. The straps 22A, 24A shown in FIG. 3 are similarly secured to the midsole 36 at the medial side 44. FIG. 18 is a cross-sectional view taken at lines 18-18 in FIG. 17 showing the base layer 18, exterior layer 20 and branch 70B secured to the midsole 36.

Figure 19:
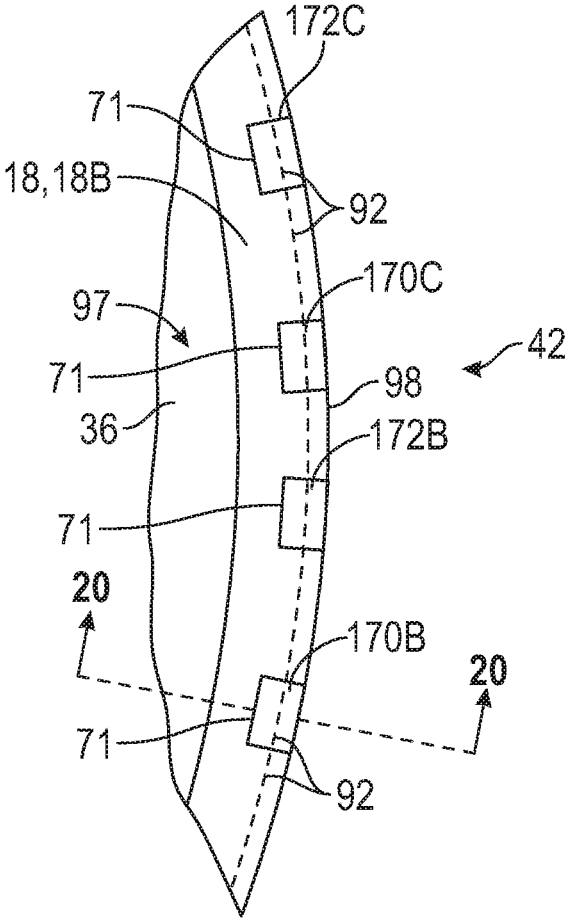
FIG. 19 is a fragmentary plan view of the upper including the straps of FIGS. 12 and 13 secured to the sole structure.
Figure 20:
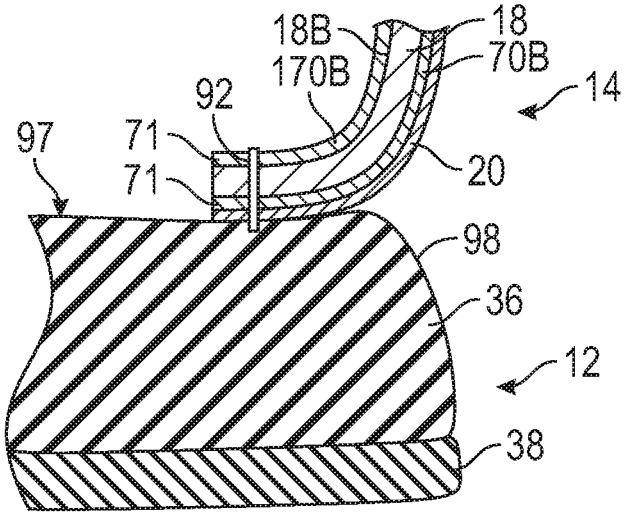
FIG. 20 is a cross-sectional view of the upper secured to the sole structure taken at lines 20-20 in FIG. 19.

FIG. 19 is a fragmentary plan view of the upper including the straps of FIGS. 12 and 13 secured to the midsole 36. The base layer 18 and the exterior layer 20 and the branches 70B, 70C, 72B, and 72C therebetween as well as the branches 170B, 170C, 172B, and 172C disposed on the inner side 18B of the base layer 18 are positioned to extend over the foot-facing surface 97 of the midsole 36 near the perimeter 98 of the midsole 36. The branches 170B, 170C, 172B, and 172C are doubled over toward their respective symmetrical branches 70B, 70C, 72B, and 72C with the base layer 18 in between. The lower ends 71 of the branches 70B, 70C, 72B, 72C, 170B, 170C, 172B, and 172C are stitched to the midsole 36 with stitches 92. The stitching 92 extends through the base layer 18 and the straps 122 and 124 and into the midsole 36. Similar straps may be secured in this manner to the midsole 36 at the medial side 44. FIG. 20 is a cross-sectional view taken at lines 20-20 in FIG. 19 showing the base layer 18, exterior layer 20 and branches 70B and 170B secured to the midsole 36.

It should be appreciated that the features of the straps 22 and 24, and straps 122 and 124 discussed with respect to FIGS. 5-20 apply equally to straps 22A and 24A, respectively.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending along a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending along a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An upper for an article of footwear comprising:

a base layer configured to define a foot-receiving cavity;

an exterior layer at least partially covering an outer side of the base layer and defining a first aperture and a second aperture both in a forefoot region of the exterior layer with the second aperture rearward of the first aperture;

a first strap and a second strap, each including a central portion, an outer front branch, and an outer rear branch, the outer front branch and the outer rear branch disposed between the outer side of the base layer and the exterior layer, the outer front branch extending forward from the central portion to a lower extent of the base layer and the outer rear branch extending rearward from the central portion to the lower extent of the base layer, the outer front branch of the second strap crossing the outer rear branch of the first strap and disposed forward of the outer rear branch of the first strap at the lower extent of the base layer;

wherein the central portion of the first strap extends through the first aperture and defines a first loop configured to receive a lace, and the central portion of the second strap extends through the second aperture and defines a second loop configured to receive the lace;

wherein the first strap and the second strap each include an inner front branch and an inner rear branch extending from the central portion and disposed at an inner side of the base layer, with the inner front branch symmetrical with the outer front branch disposed at the outer side of the base layer and the inner rear branch symmetrical with the outer rear branch disposed at the outer side of the base layer;

wherein the first strap is a unitary, continuous piece that doubles over a top edge of the base layer at a throat opening defined by the base layer so that the outer front branch of the first strap and the outer rear branch of the first strap are disposed at the outer side of the base layer and the inner front branch of the first strap and the inner rear branch of the first strap are disposed at the inner side of the base layer;

and wherein the second strap is a unitary, continuous piece that doubles over the top edge of the base layer at the throat opening so that the outer front branch of the second strap and the outer rear branch of the second strap are disposed at the outer side of the base layer and the inner front branch of the second strap and the inner rear branch of the second strap are disposed at the inner side of the base layer.

2. The upper of claim 1, wherein the central portion of the first strap is secured at the inner side of the base layer to define the first loop and/or the central portion of the second strap is secured at the inner side of the base layer to define the second loop.

3. The upper of claim 1, wherein: the outer front branch and the outer rear branch of the first strap are unaffixed between the lower extent of the base layer and the central portion of the first strap; and the outer front branch and the outer rear branch of the second strap are unaffixed between the lower extent of the base layer and the central portion of the second strap.

4. The upper of claim 1, wherein: the outer front branch and the outer rear branch of the first strap are affixed to the outer side of the base layer between the lower extent of the base layer and the central portion of the first strap;

and the outer front branch and the outer rear branch of the second strap are affixed to the outer side of the base layer between the lower extent of the base layer and the central portion of the second strap.

5. The upper of claim 1, wherein the outer front branch of the second strap is affixed to the outer rear branch of the first strap where the outer front branch of the second strap crosses the outer rear branch of the first strap.

6. The upper of claim 1, wherein the first strap and the second strap extend along the inner side of the base layer in the foot-receiving cavity to the lower extent of the base layer.

7. The upper of claim 1, wherein the first strap and the second strap are unaffixed to the base layer except at the lower extent of the base layer.

8. The upper of claim 1, wherein the outer front branch of the second strap crosses over an outer side of the outer rear branch of the first strap.

9. The upper of claim 1, wherein a portion of the exterior layer overlaying the first strap and the second strap is transparent or translucent.

10. The upper of claim 1, wherein the first strap and the second strap are an inextensible material.

11. The upper of claim 1, wherein the first aperture, the second aperture, the first strap, and the second strap are disposed at a medial side of the base layer with the first loop and the second loop disposed at a throat opening defined by the base layer.

12. The upper of claim 1, wherein the first aperture, the second aperture, the first strap, and the second strap are disposed at a lateral side of the base layer with the first loop and the second loop disposed at a throat opening defined by the base layer.

13. The upper of claim 12, wherein the exterior layer further defines a third aperture and a fourth aperture both disposed at a medial side of the base layer in the forefoot region of the base layer with the fourth aperture rearward of the third aperture, and the upper further comprising:

a third strap and a fourth strap, each including a central portion, a front branch, and a rear branch, the front branch and the rear branch disposed between the base layer and the exterior layer, the front branch extending forward from the central portion to a lower extent of the base layer, and the rear branch extending rearward from the central portion to the lower extent of the base layer;

wherein the central portion of the third strap extends out from between the base layer and the exterior layer through the third aperture and defines a third loop configured to receive the lace, the central portion of the fourth strap extends out from between the base layer and the exterior layer through the fourth aperture and defines a fourth loop configured to receive the lace, and the front branch of the fourth strap crossing the rear branch of the third strap and disposed forward of the rear branch of the third strap at the lower extent of the base layer.

14. The upper of claim 1, wherein:

the central portion, the outer front branch and the outer rear branch of the first strap form a shape of an inverted Y;

and the central portion, the outer front branch and the outer rear branch of the second strap form a shape of an inverted Y.

15. The upper of claim 1, wherein a lower end of the outer front branch of the first strap, a lower end of the outer rear branch of the first strap, and a lower end of the outer front branch of the second strap are positioned in the forefoot region of the upper, and a lower end of the outer rear branch of the second strap is positioned in a midfoot region of the upper.

16. The upper of claim 1, wherein a portion of the exterior layer overlaying the first strap and the second strap is a translucent stretch woven material.

17. The upper of claim 1, wherein the first strap and the second strap each have a width and a thickness, and the width is at least three times greater than the thickness.

18. An article of footwear comprising:

a sole structure;

an upper including an inner layer and an outer layer, the inner layer secured at a lower extent to the sole structure and defining a foot-receiving cavity, the outer layer at least partially covering an outer side of the inner layer at a forefoot region of the upper and including a first aperture and a second aperture;

the upper further comprising a first anchoring strap and a second anchoring strap each having a central portion, a front branch, and a rear branch, the front branch and the rear branch both diverging from the central portion and extending downward between the inner layer and the outer layer and secured at the sole structure, the front branch of the second anchoring strap crossing the rear branch of the first anchoring strap and disposed forward of the rear branch of the first anchoring strap at the sole structure, the central portion of the first anchoring strap emerging from between the inner layer and the outer layer through the first aperture and defining a first loop, the central portion of the second anchoring strap emerging from between the inner layer and the outer layer through the second aperture and defining a second loop;

a lace engaged with both the first loop and the second loop;

wherein a portion of the sole structure extends upward on an outer side of the outer layer and above a biteline between the upper and the sole structure to a peak that overlies a portion of one or both of the first anchoring strap and the second anchoring strap;

an overlay between the outer layer and the peak of the sole structures; wherein an outer periphery of the overlay follows an outer periphery of the peak;

wherein the first anchoring strap is a single component of a unitary material and is doubled over at the central portion of the first anchoring strap so that an outer front branch of the first anchoring strap and an outer rear branch of the first anchoring strap are disposed at the outer side of the inner layer and an inner front branch of the first anchoring strap and an inner rear branch of the first anchoring strap are disposed at an inner side of the inner layer; and wherein the second anchoring strap is a single, unitary component and is doubled over at the central portion of the second anchoring strap so that an outer front branch of the second anchoring strap and an outer rear branch of the second anchoring strap are disposed at the outer side of the inner layer and an inner front branch of the second anchoring strap and an inner rear branch of the second anchoring strap are disposed at an inner side of the inner layer.

19. The article of footwear of claim 18, wherein the portion of the sole structure extending upward on the outer side of the outer layer and above the biteline is between the front branch of the second anchoring strap and the rear branch of the second anchoring strap, and wherein the overlay is thicker, denser, or both thicker and denser than the outer layer.

* * * * *